US011598119B2

(12) United States Patent
Creighton

(10) Patent No.: US 11,598,119 B2
(45) Date of Patent: Mar. 7, 2023

(54) SECURABLE DEADBOLT, HINGE, AND SLIDING ASSEMBLIES

(71) Applicant: Travis Brett Creighton, Tampa, FL (US)

(72) Inventor: Travis Brett Creighton, Tampa, FL (US)

( * ) Notice: Subject to any disclaimer, the term of this patent is extended or adjusted under 35 U.S.C. 154(b) by 0 days.

(21) Appl. No.: 16/874,151

(22) Filed: May 14, 2020

(65) Prior Publication Data

US 2021/0355712 A1 Nov. 18, 2021
US 2022/0064998 A9 Mar. 3, 2022

Related U.S. Application Data

(60) Provisional application No. 62/888,453, filed on Aug. 17, 2019.

(51) Int. Cl.

*E05B 17/20* (2006.01)
*E05B 63/12* (2006.01)
*E05B 15/02* (2006.01)
*E05D 11/00* (2006.01)
(Continued)

(52) U.S. Cl.

CPC ..... *E05B 17/2088* (2013.01); *E05B 15/0205* (2013.01); *E05B 63/0008* (2013.01); *E05B 63/12* (2013.01); *E05B 63/121* (2013.01); *E05C 1/00* (2013.01); *E05D 11/0027* (2013.01); *E05D 2011/0045* (2013.01); *E05Y 2800/426* (2013.01)

(58) Field of Classification Search

CPC .... E05B 15/02; E05B 15/0205; E05B 15/022; E05B 17/2084; E05B 17/2088; E05B 63/12; E05B 63/121; E05B 63/123; E05C 1/00; E05C 1/002; E05C 1/004; E05C 1/02; E05C 1/06; E05D 11/0018; E05D 11/002; E05D 2011/0036; E05D 2011/0045; E05Y 2800/426

See application file for complete search history.

(56) References Cited

U.S. PATENT DOCUMENTS 1,901,412 A * 3/1933 Richter ..... E05B 17/2084 70/144
2,709,612 A * 5/1955 Fox ..... E05B 17/2088 292/DIG. 41
(Continued)

FOREIGN PATENT DOCUMENTS

AU 2006200379 A1 1/2006
AU 2008258144 A1 12/2008
(Continued)

OTHER PUBLICATIONS

International Search Report, PCT/US2021/031895, dated Aug. 12, 2021.

*Primary Examiner* — Christopher J Boswell

(57) ABSTRACT

Various disclosed embodiments include a lock assembly. The lock assembly includes a lock bolt. The lock bolt has a lock bolt body and having a bolt security engagement feature formed as part of the lock bolt body. The lock assembly also includes a receiver. The receiver has a receiving area for receiving at least a portion of the lock bolt and the receiver has a receiver security engagement feature formed as part of the receiver. The receiver security engagement feature is complementary to the lock bolt security engagement feature.

12 Claims, 11 Drawing Sheets

(51) Int. Cl.
*E05B 63/00* (2006.01)
*E05C 1/00* (2006.01)

(56) References Cited

U.S. PATENT DOCUMENTS 3,175,376 A * 3/1965 Cantwell ..... E05B 17/042 70/145
3,948,550 A * 4/1976 Vigluicci ..... E05B 17/2003 292/346
4,312,527 A * 1/1982 Tannery ..... E05B 17/2088 292/49
4,566,725 A * 1/1986 Klein ..... E05B 63/127 292/191
5,452,928 A * 9/1995 Donald ..... E05B 63/127 292/191
5,531,487 A * 7/1996 Beresheim ..... E05B 63/12 292/146
5,746,458 A * 5/1998 Fisher ..... E05B 63/121 292/144
6,113,160 A * 9/2000 Johansson ..... E05C 5/00 292/DIG. 37
7,261,332 B1 * 8/2007 Petersen ..... E05B 15/021 292/121
2018/0298640 A1 * 10/2018 Caterino ..... E05B 15/02

FOREIGN PATENT DOCUMENTS

DE 202006001574 U1 6/2007
DE 202007005134 U1 8/2007
EP 3255237 A1 12/2017
FR 2307106 A1 11/1976
NL 1006600 C2 1/1999

* cited by examiner

SECURABLE DEADBOLT, HINGE, AND SLIDING ASSEMBLIES

TECHNICAL FIELD

The present disclosure relates to security mechanisms for doors, windows, gates, and the like.

BACKGROUND

The statements in this section merely provide background information related to the present disclosure and may not constitute prior art.

Conventional residential doors typically use wood framing for securing doors. This wood framing can be easily compromised by forces generated by a person kicking or throwing their weight against the door. Methods exist to reinforce the door framing but those can be costly, time consuming, and involved depending on the requirements of the door. Some reinforcements negatively change the appearance of the door.

Accordingly there is a need for a reinforcement for doors which provides increased resistance in the case that a door, window, safe, or gate is being forced open by kicking, prying or by providing a blunt force against the door among other possibilities.

SUMMARY

Disclosed embodiments include structures and methods for improving the assembly of vehicle doors.

An illustrative embodiment includes a door lock assembly. The door lock assembly includes a lock bolt. The lock bolt has a lock bolt body and having a bolt security engagement feature formed as part of the lock bolt body. The door lock assembly also includes a receiver. The receiver has a receiving area for receiving at least a portion of the lock bolt and the receiver has a receiver security engagement feature formed as part of the receiver. The receiver security engagement feature is complementary to the lock bolt security engagement feature.

Another illustrative embodiment includes a hinge assembly. The hinge assembly includes a first hinge plate. The hinge assembly also includes a hinge receiver coupled with the first hinge plate and having a hinge receiver security engagement feature formed as part of the hinge receiver. The hinge assembly further includes a second hinge plate coupled to the first hinge plate at a pivot joint. Further still, the hinge assembly includes a hinge bolt, the hinge bolt having a hinge bolt body and having a hinge bolt security engagement feature formed as part of the hinge bolt body, the hinge bolt security engagement feature being complementary to the hinge receiver security engagement feature.

Another illustrative embodiment includes a door lock. The door lock includes a lock bolt, the lock bolt has a lock bolt body and has a bolt security engagement feature formed as part of the lock bolt body. The door lock also includes a receiver, the receiver having a receiving area for receiving at least a portion of the lock bolt and the receiver having a receiver security engagement feature formed as part of the receiver, the receiver security engagement feature being complementary to the lock bolt security engagement feature. Further, the door lock includes a door lock drive coupled with the lock bolt and configured to drive the lock bolt in and out of the receiver.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

Illustrative embodiments are illustrated in referenced figures of the drawings. It is intended that the embodiments and figures disclosed herein are to be considered illustrative rather than restrictive.

Like reference symbols in the various drawings generally indicate like elements.

DETAILED DESCRIPTION

Figure 1:
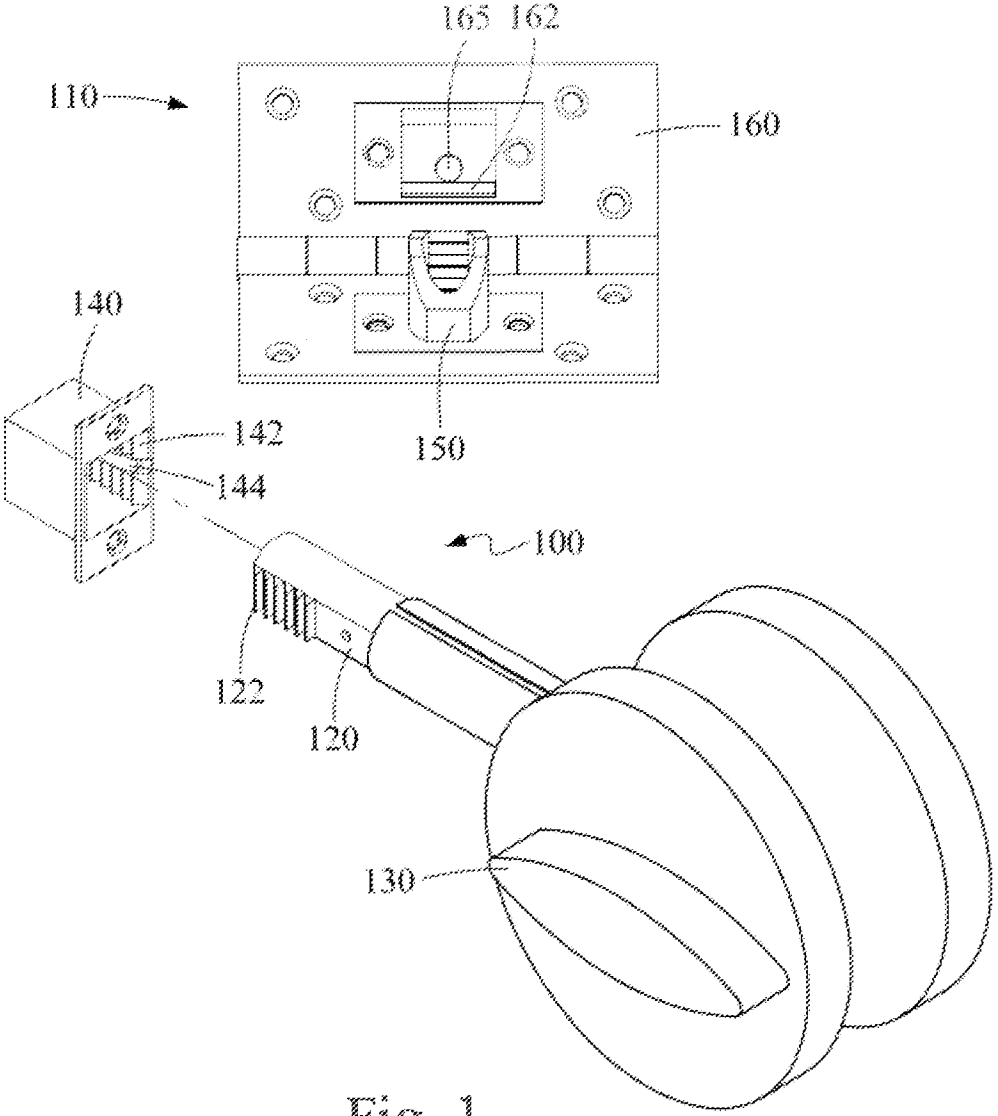
FIG. 1 is a perspective view showing multiple illustrative embodiments.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Illustrative embodiments are related to a door lock bolt (such as a deadbolt) having teeth cut into it and a receiver of the bolt that is installed in the door frame which has complimentary teeth cut into it. The receiver may have a hole at the back side that allows a suitable screw or other fastener to be installed securing the receiver to the door frame, studs, king stud or masonry block, if that is the building material used. A spring is attached within the receiver (or alternatively, the spring may be on the bolt), to separate the teeth of the bolt and receiver when no force to open the door is being applied. Separation of the teeth from engagement with each other makes it easy to open the door in a typical way. However, if the door were attempted to be forced open by kicking or applying a blunt force to it, the spring separating the teeth would collapse and the teeth would engage. This engagement transfers the force applied upon the door to the screw holding the receiver to the door frame, stud, king stud, or masonry block. By providing the bolt and receiver combinations disclosed herein, greater security for doors may be achieved. Interlocking the securing bolt to the receiver of the bolt and the portion of the hinge attached to the door to the portion of the hinge attached to the door's frame provides for increased reinforcement without changing the look or structure of a conventional door and door frame. Not only does the illustrative bolt receiver combination help prevent forced entry by blunt force to the door such as by kicking, but it also helps prevent forced entry by deforming the door or frame by prying.

Referring now to FIG. 1, an illustrative deadbolt assembly 100 for a door and an illustrative hinge assembly 110 for coupling a door to a door frame. Deadbolt assembly 100 includes a deadbolt 120 which is actuated by a locking mechanism 130. Locking mechanism 130 may be a manually operated mechanism as depicted or may be a power actuated mechanism as is common with many smart lock devices today. In accordance with an illustrative embodiment, deadbolt 120 includes a set of teeth 122. Deadbolt assembly 120 includes a receiver 140 which is configured to be mounted within a door frame. Receiver 140 includes a set of opposing receiver teeth 142 and a biasing spring 144. When operated, teeth 122 face receiver teeth 142 but are biased from engaging with each other by biasing spring 144. Biasing spring may be a curved leaf spring, but other biasing spring configurations and biasing mechanisms may be used without departing from the scope of the invention. Thus, during normal operation deadbolt 120 slides in and out of receiver 140 unimpeded. When a door using deadbolt assembly 120 is attempted to be opened by force, which may include but is not limited to kicking the door or prying the door, deformations in the door and the frame will cause biasing spring 144 to deform and be depressed such that deadbolt teeth 122 engage with receiver teeth 142. Once engaged, force is transferred to receiver 140 which, if properly installed, is fastened securely to the door frame and to wall framing or masonry, thereby helping to maintain the security of the door.

Similarly, hinge 110 includes a bolt 150 which has teeth like bolt 120. Hinge 110 also includes a receiver 160 which is configured as a part of a hinge plate 162. Receiver 160 may be formed with hinge plate 162 or may be configured to attach to hinge plate 162 by any of a variety of ways including but not limited to screws. Receiver 160 includes complementary receiver teeth similar to the receiver teeth of deadbolt assembly receiver 140 and with a biasing spring similar to the biasing spring 144 of receiver 140. Hinge 160 works similarly to deadbolt 120, such that when the door is swung shut normally, bolt 150 slides easily into receiver 160 with the spring being biased. If the door is being forced open, the frame or door may be deformed and cause the teeth of bolt 150 to engage teeth 160. Receiver 160 is affixed to door frame and further to king studs or masonry with one or more affixing screws through a hole 165 in receiver 160. Because the fastener hole 165 is in the back of receiver 160, it is closer to the studs and can be used to hold receiver 160 in place during an attempted forceful entry.

Figure 2:
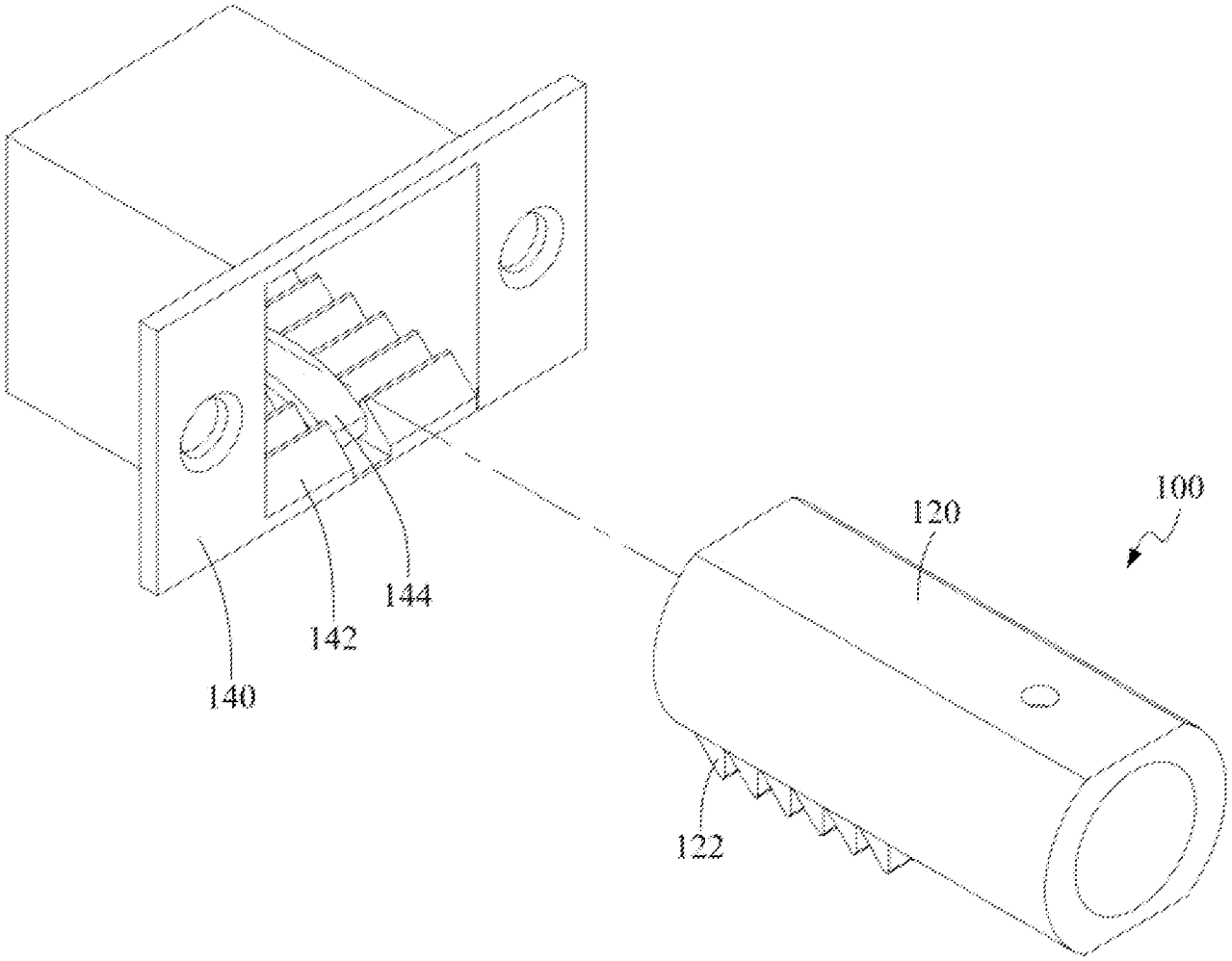
FIG. 2 is a perspective view of an illustrative bolt and receiver combination.

Referring now to FIG. 2, an alternative view of a deadbolt 120 is depicted, with teeth 122, that is configured to work in conjunction with receiver 140, having teeth 142 and biasing spring 144 as described with respect to FIG. 1.

Figure 3:
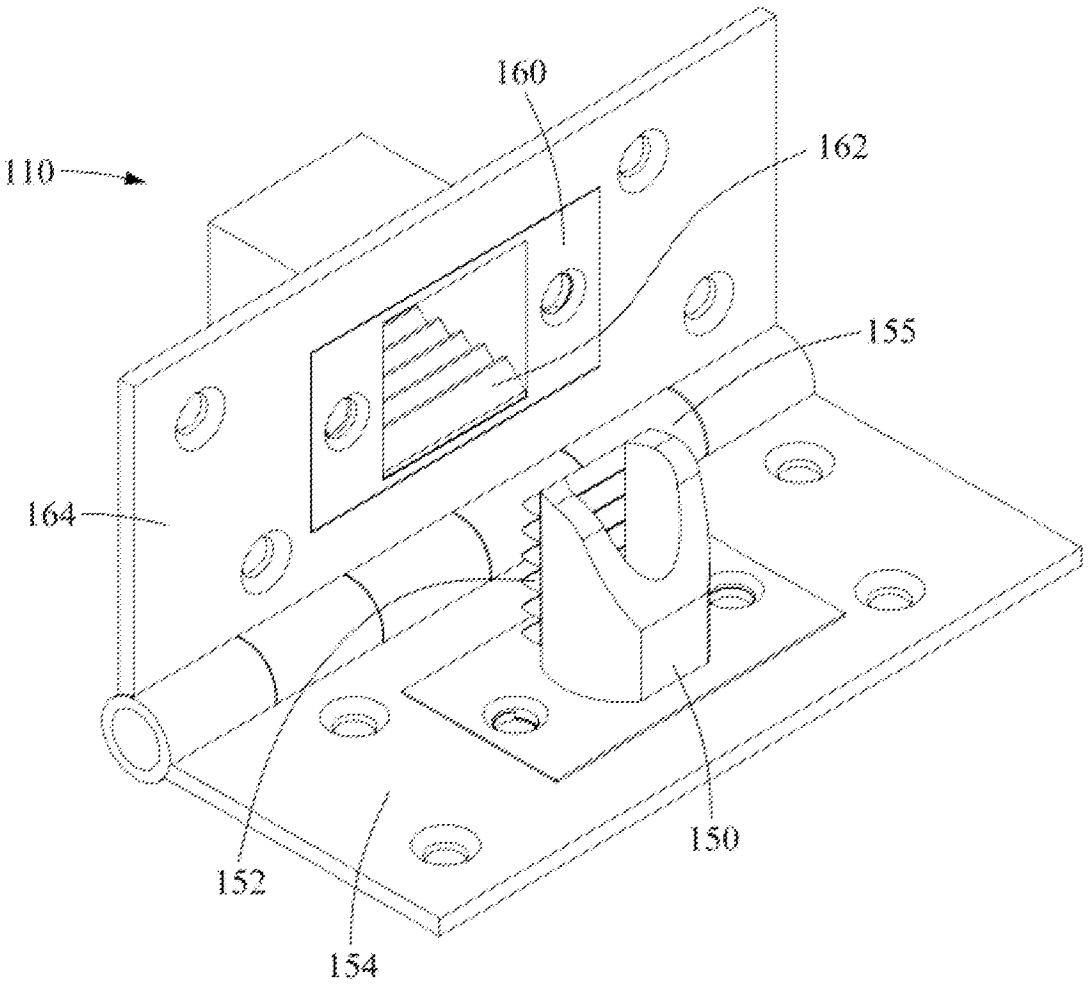
FIG. 3 is a perspective view of a hinge having an exemplary bolt and receiver combination.

Referring now to FIG. 3, an alternative view of a hinge assembly 110 is depicted. Hinge assembly 110 includes two plates 154 and 164 coupled at a hinge pivot 155 which may be a pin or other type of pivot. A hinge bolt 150 is coupled to plate 154 and includes teeth 152, that is configured to work in conjunction with receiver 160, having teeth 162 and an optional biasing spring as described with respect to FIG. 1. In many configurations, biasing spring 162 is not needed because bolt 150 is constrained to move by bivot 162 and therefore prevents the teeth 152 and 162 from engaging unless there is a deforming event such as a forceful entry attempt.

Figure 4:
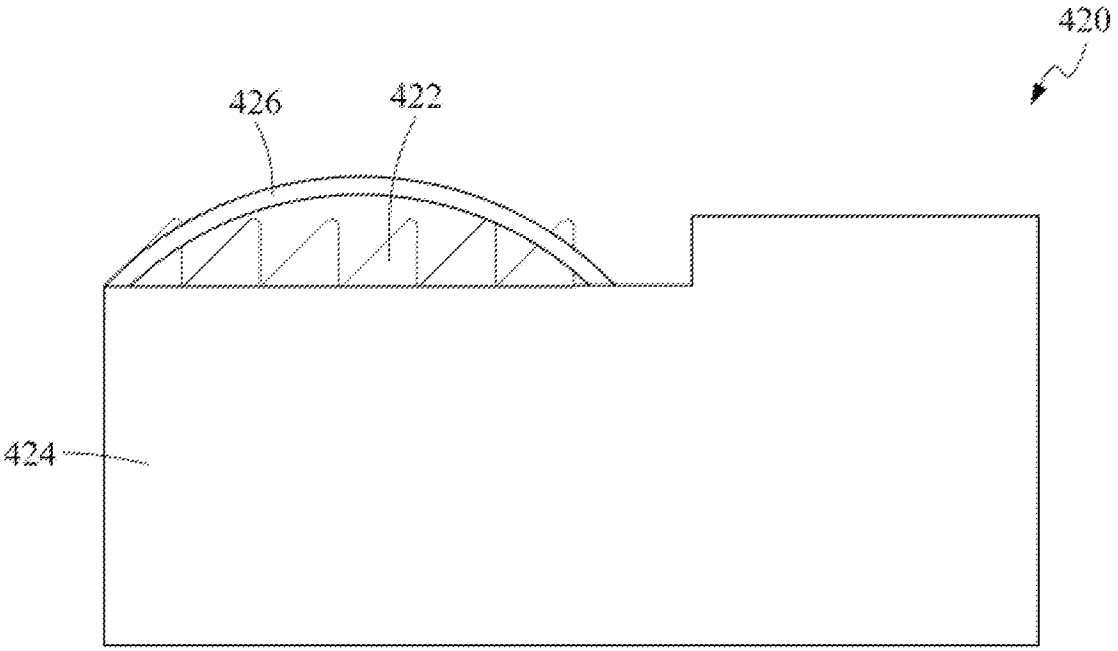
FIG. 4 is an illustrative embodiment of a bolt with a double spring combination.
Figure 5:
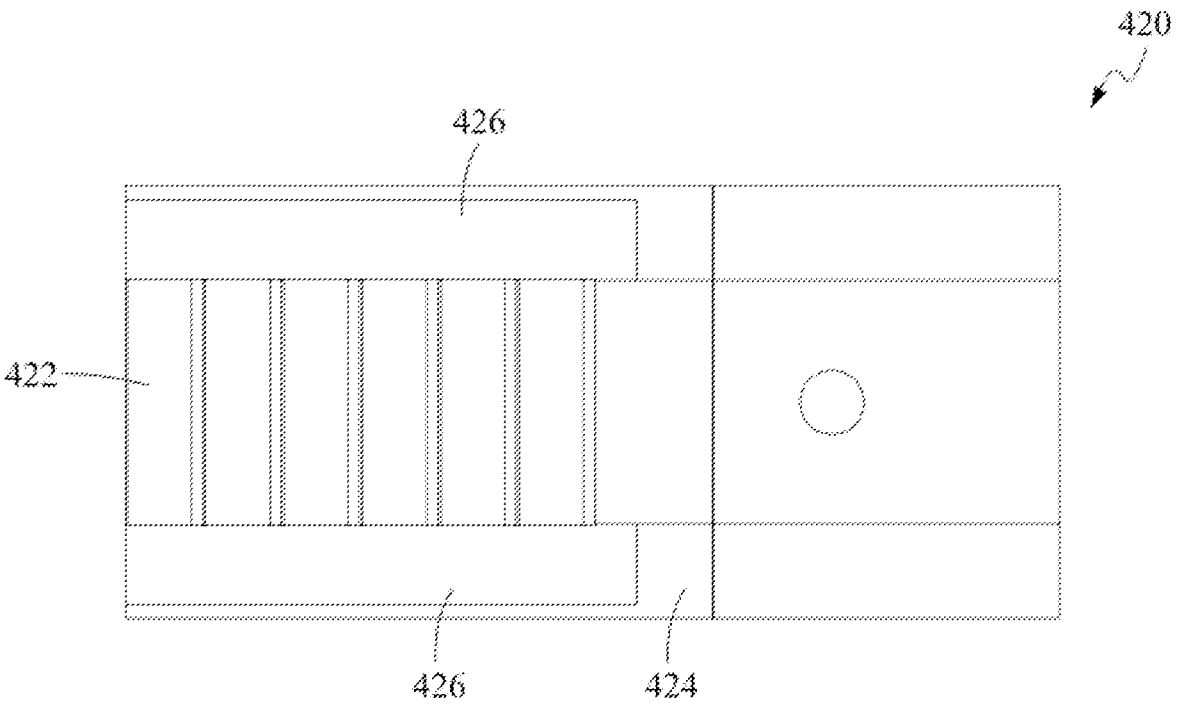
FIG. 5 is an illustrative embodiment of the bolt depicted in FIG. 4.

Referring now to FIGS. 4 and 5, an illustrative alternative bolt 420 which may be adapted to be used with a hinge assembly or a deadbolt assembly is depicted. Bolt 420 includes a set of bolt teeth 422 supported by a bolt body 424. A biasing spring 426 is depicted along both sides of the teeth. In an illustrative embodiment, it may be desirable to have the biasing springs attached at one end of the spring to the bolt body and free to move at the other end so that when deformed, the biasing spring is easily moved out of the way of bolt teeth 422. In one embodiment, there may be two biasing springs, one on each sides of teeth 422, as depicted in FIGS. 4 and 5. While in other illustrative embodiments, it may be desirable to use a single biasing spring, which may reside in the middle of two rows of bolt teeth. In accordance with alternative embodiments, the biasing springs may be located on either of the bolt or the receiver without departing from the scope of the invention.

Figure 6:
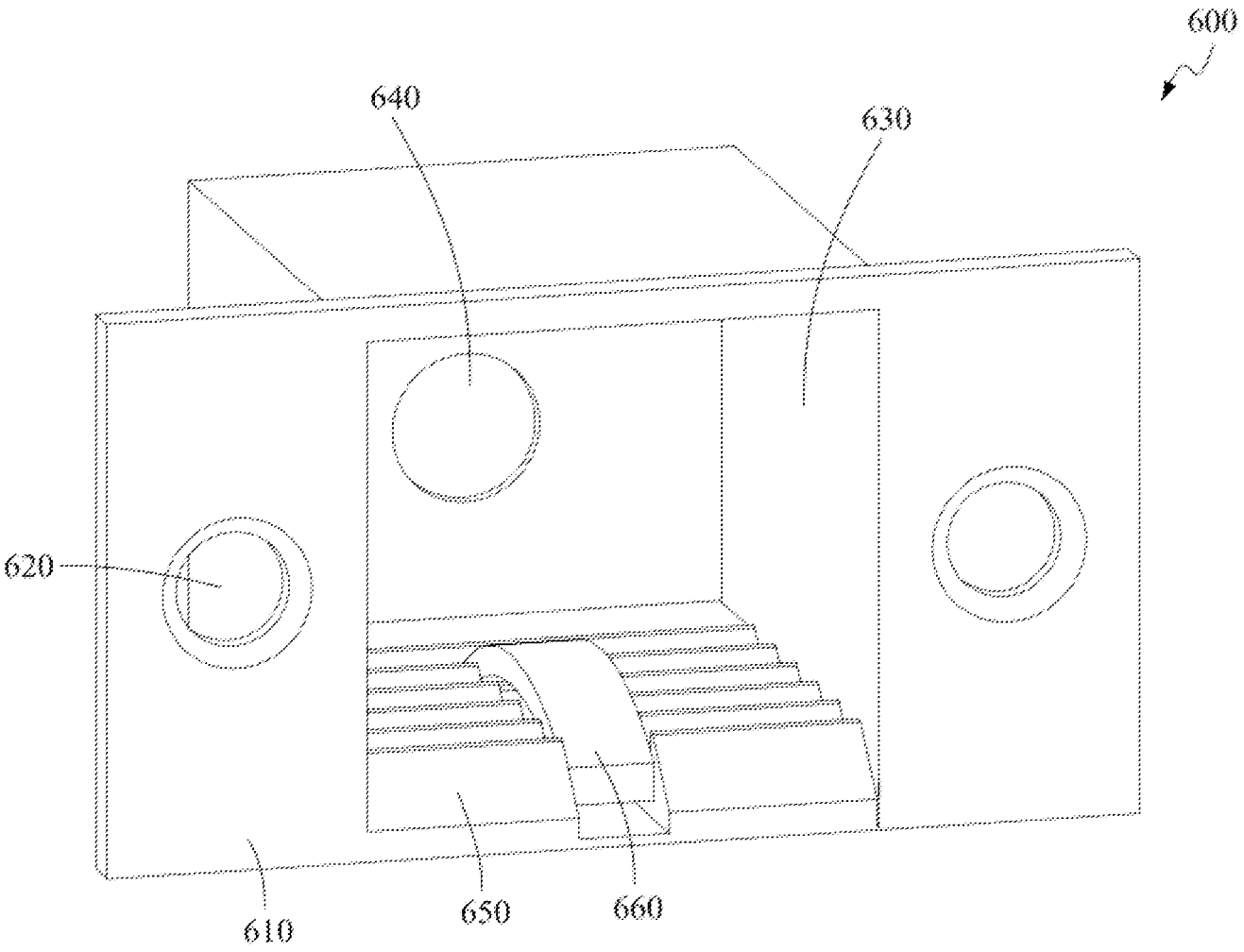
FIG. 6 is an illustrative embodiment of a receiver for a deadbolt.

Referring now to FIG. 6, two views of an illustrative embodiment of a receiver 600 which can be used for either of a deadbolt lock or a hinge as described above and depicted in FIG. 1, is depicted. Receiver 600 includes a support plate 610 having formed therein one or more apertures 620 for affixing to a door frame with screws or other fasteners. Support plate 610 is coupled to and supports a receiver box 630 which is configured to receive the locking bolt of the deadbolt assembly or the security bolt of the hinge assembly. Receiver box 630 has one or more securing apertures 640 which are used to receive a securing screw or other fastener that is used to secure receiver 600 to a king stud, other stud, or masonry to provide extra security in case of an attempted forced entry. To secure the door and the bolt to the receiver during a forced entry, teeth 650 are provided to engage with complimentary teeth of a bolt. During normal use a biasing spring 660 prevents teeth 650 from engaging with bolt teeth as the bolt moves in and out of receiver box 630.

Figure 7:
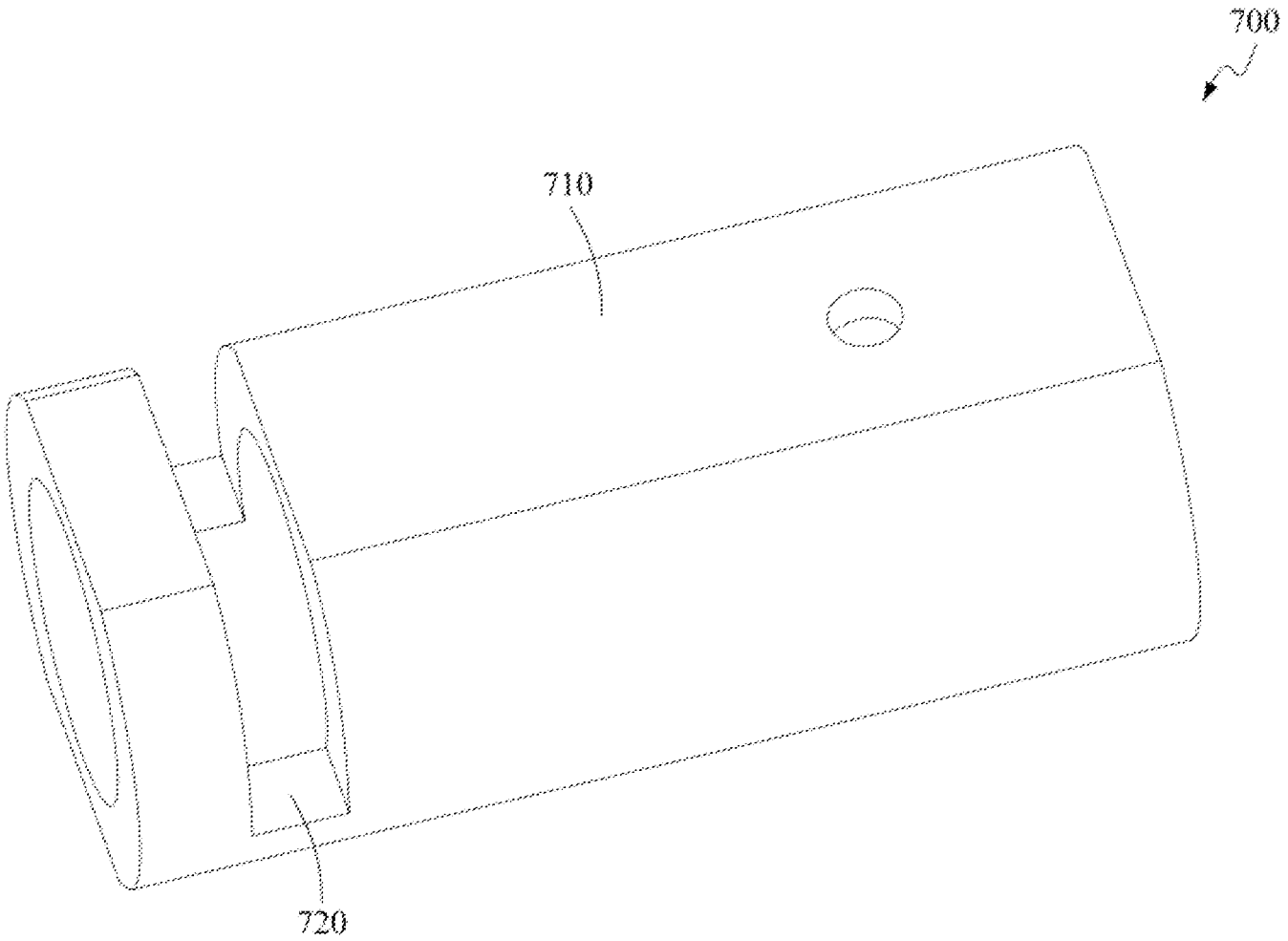
FIG. 7 is an illustrative embodiment of an alternative bolt.
Figure 8:
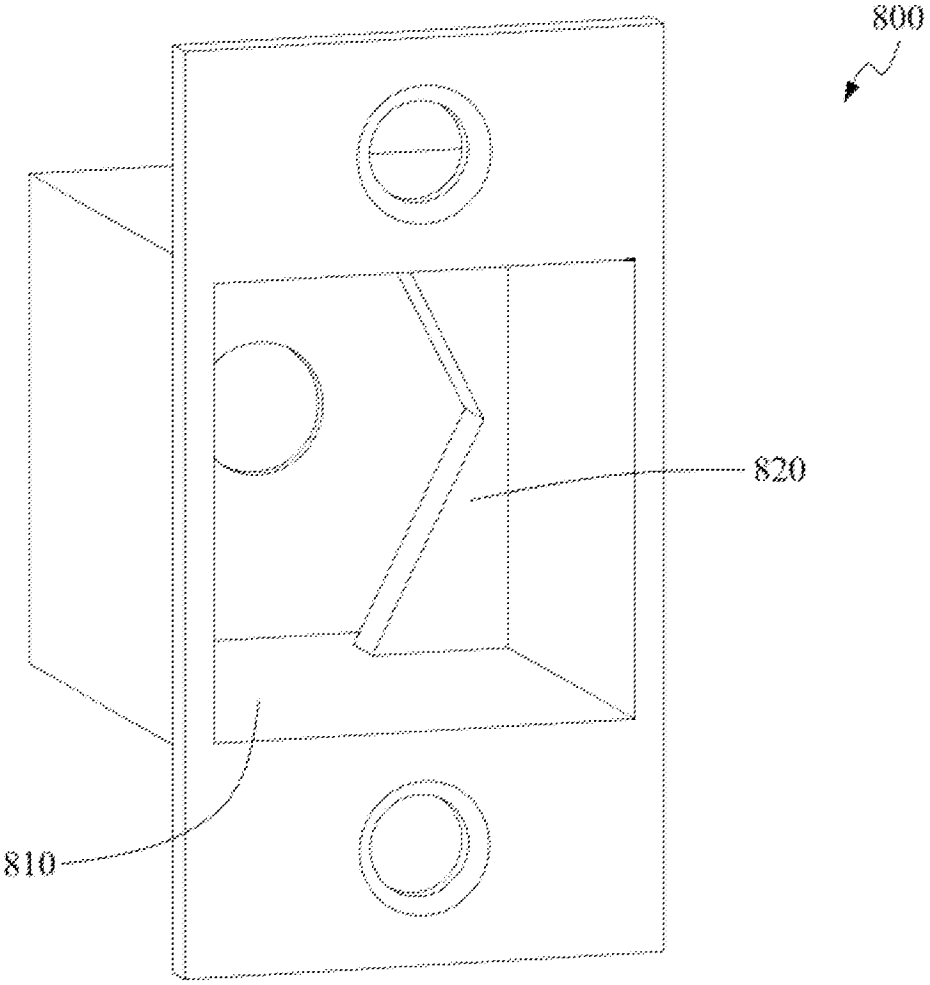
FIG. 8 is an illustrative embodiment of an alternative receiver complementary to the bolt of FIG. 7.

Referring now to FIG. 7, an alternative illustrative embodiment of a bolt 700 to be used with a deadbolt or hinge similar to the deadbolt assembly or hinge of FIG. 1, is depicted. Similarly, referring to FIG. 8, an alternative illustrative embodiment of a receiver 800 to be used with a deadbolt or hinge similar to the deadbolt assembly or hinge of FIG. 1, is depicted. Bolt 700 includes a bolt body 710 and a slot 720 formed therein. Bolt 700 is configured to slide in and out of a receiver box 810 of receiver 800. Receiver box 810 includes a projection formed as a complement to slot 720. If a door is being forced open, bolt 700 may move such that slot 720 engages with projection 820 to hold the bolt 700 within receiver box 810 creating increased security for the door.

Figure 9:
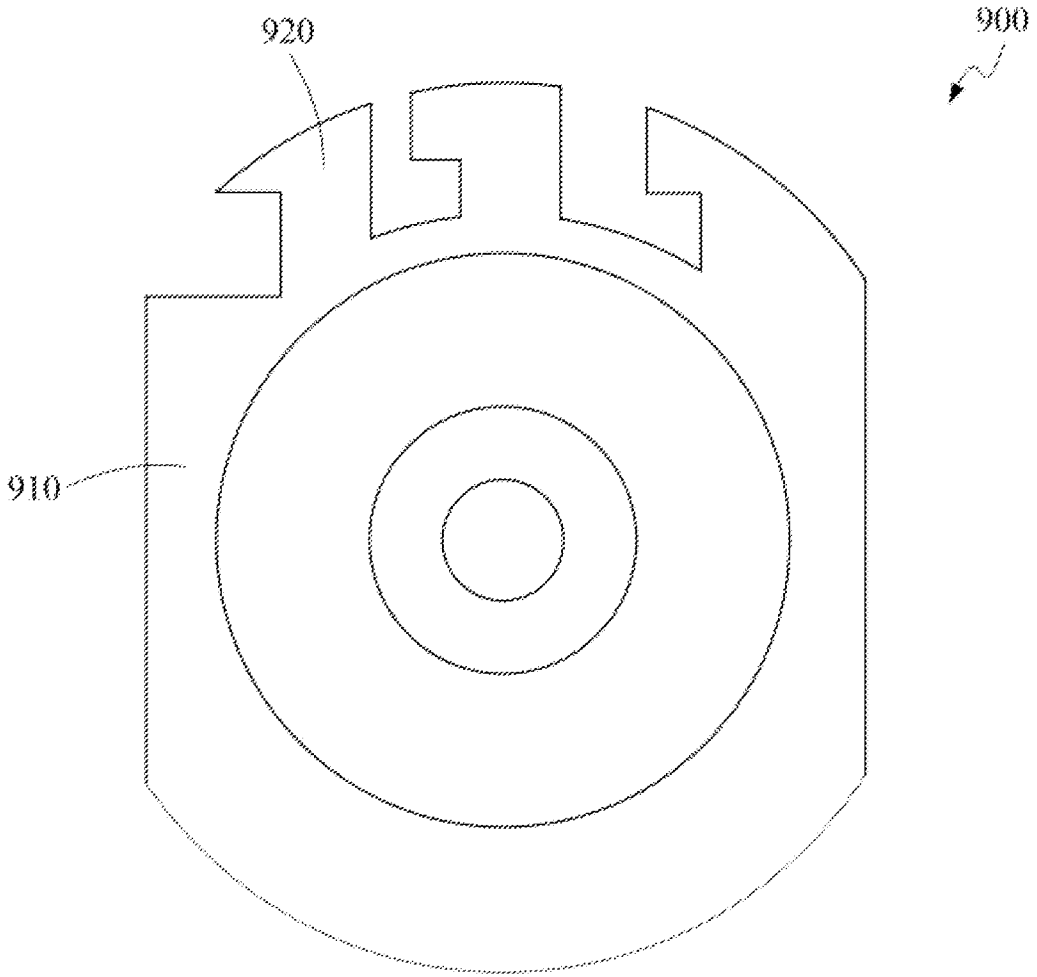
FIG. 9 is an illustrative embodiment of an alternative bolt.
Figure 10:
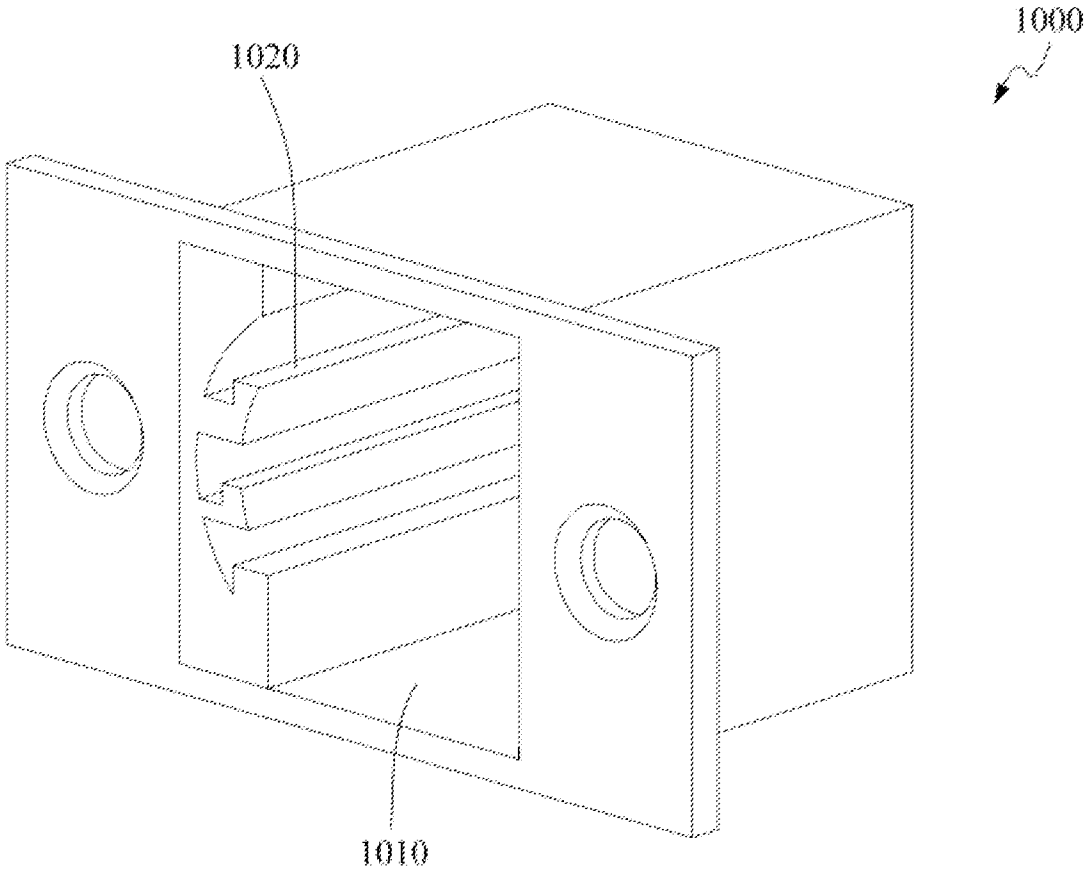
FIG. 10 is an illustrative embodiment of an alternative receiver complementary to the bolt of FIG. 9.

Referring now to FIG. 9, an alternative illustrative embodiment of a bolt 900 to be used with a deadbolt similar to the deadbolt assembly of FIG. 1, is depicted. Similarly, referring to FIG. 10, an alternative illustrative embodiment of a receiver 1000 to be used with a deadbolt similar to the deadbolt assembly of FIG. 1, is depicted. Bolt 900 includes a bolt body 910 and a set of keyed projections and slots 920 formed therein. Bolt 900 is configured to slide in and out of a receiver box 910 of receiver 900. Receiver box 910 includes a set of keyed projections formed as a complement to slot 920. If a door is being forced open, bolt 900 may be prevented from moving because of the keyed engagement with the set of projection 1020 to hold the bolt 900 within receiver box 910 creating increased security for the door.

During normal usage, the bolt is configured to move in and out of receiver box 1010 with keyed projections sliding within the channels created by the set of complementary keyed projections 1020.

Figure 11:
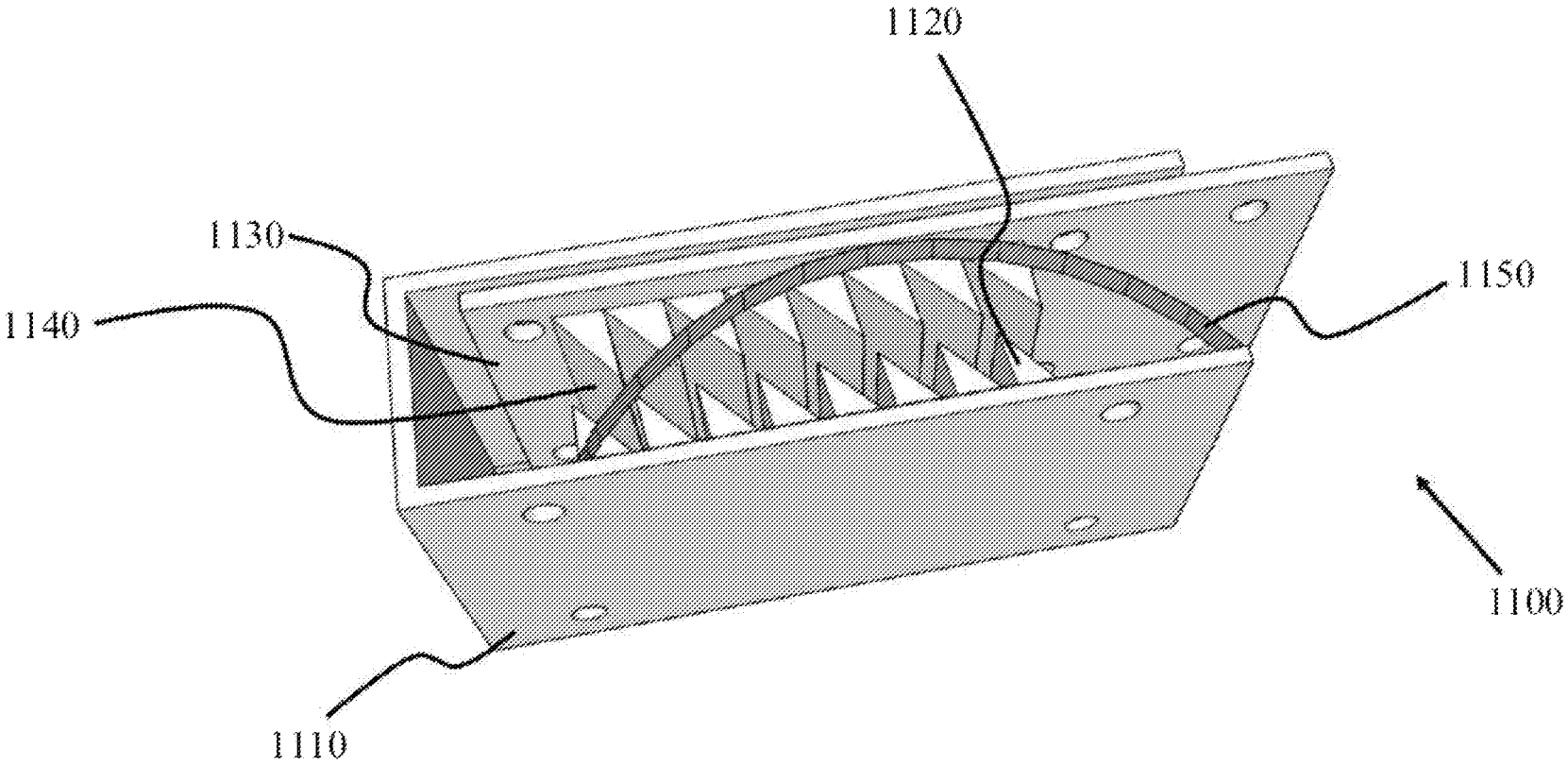
FIG. 11 is an illustrative embodiment of an alternative receiver plate combination.

Referring now to FIG. 11, an alternative receiver and plate assembly 1100 is depicted. Assembly 1100 includes a receiver section 1110 which may be a receiver for any of a variety of sliding doors, gates, sliding windows, tracked doors, tracked windows and the like. Receiver 1110 includes a set of teeth 1120 which during normal opening an closing operation do not engage with teeth 1140 of a plate 1130 that slides into and out of receiver 1110 biased from engaging by one or more springs 1150. Plate 1130 is another embodiment of the bolt as described above. As described with respect to other various embodiments, when the door or window is being forced open, teeth 1120 engage with teeth 1130 as spring 1150 is deformed, providing an extra layer of security against the forceful entry.

All of the above embodiments may be used with or without biasing springs depending on the application. In some applications the biasing spring may be necessary for proper normal operation while in other applications the biasing spring may not be necessary.

As described above, the illustrative embodiments may be applied to any situation or structure where it is advantageous to provide another level of security to a forceful entry, including but not limited to doors, windows, sliding gates, sliding doors, rolling garage doors, safes, etc.

In some instances, one or more components may be referred to herein as "configured to," "configured by," "configurable to," "operable/operative to," "adapted/adaptable," "able to," "conformable/conformed to," etc. Those skilled in the art will recognize that such terms (e.g. "configured to") generally encompass active-state components and/or inactive-state components and/or standby-state components, unless context entails otherwise.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flows are presented in a sequence(s), it should be understood that the various operations may be performed in other orders than those which are illustrated or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

While the disclosed subject matter has been described in terms of illustrative embodiments, it will be understood by those skilled in the art that various modifications can be made thereto without departing from the scope of the claimed subject matter as set forth in the claims.

What is claimed is:

1. A lock assembly, comprising:

a lock bolt, the lock bolt having a lock bolt body and having a bolt security engagement feature formed as part of the lock bolt body;

a receiver, the receiver having a receiving area for receiving at least a portion of the lock bolt and the receiver having a receiver security engagement feature formed as part of the receiver, the receiver security engagement feature being complementary to the lock bolt security engagement feature; and at least one biasing spring, the at least one biasing spring configured to bias the bolt security engagement feature from engaging with the receiver security engagement feature when the lock bolt is at rest in a position received within the receiver.

2. The lock assembly of claim 1, wherein the bolt security engagement feature comprises at least one projection.

3. The lock assembly of claim 1, wherein the bolt security engagement feature comprises at least one set of teeth.

4. The lock assembly of claim 1, wherein the bolt security engagement feature comprises keyed projections.

5. The lock assembly of claim 1, wherein the bolt security engagement feature comprises at least one slot and projection.

6. The lock assembly of claim 1, wherein the receiver includes one biasing spring of the at least one biasing spring.

7. The door lock assembly of claim 1, wherein the receiver includes more than one biasing spring of the at least one biasing spring.

8. The lock assembly of claim 1, wherein the at least one biasing spring includes a biasing leaf spring in the receiver.

9. The lock assembly of claim 1, wherein the lock bolt includes one biasing spring of the at least one biasing spring.

10. The lock assembly of claim 1, wherein the door lock assembly includes a lock bolt drive.

11. The lock assembly of claim 1, wherein the door lock assembly includes a lock bolt drive and the lock bolt drive includes an electric motor.

12. A lock, comprising:

a lock bolt, the lock bolt having a lock bolt body and having a bolt security engagement feature formed as part of the lock bolt body;

a receiver, the receiver having a receiving area for receiving at least a portion of the lock bolt and the receiver having a receiver security engagement feature formed as part of the receiver, the receiver security engagement feature being complementary to the lock bolt security engagement feature;

a lock drive coupled with the lock bolt and configured to drive the lock bolt in and out of the receiver; and at least one biasing spring, the at least one biasing spring configured to bias the bolt security engagement feature from engaging with the receiver security engagement feature when the lock bolt is at rest in a position received within the receiver.

* * * * *